United States Patent [19]

Humke

[11] Patent Number: 4,537,028

[45] Date of Patent: Aug. 27, 1985

[54] EXHAUST PORT

[75] Inventor: Albert L. Humke, Cedar Falls, Iowa

[73] Assignee: Deere & Company, Moline, Ill.

[21] Appl. No.: 520,924

[22] Filed: Aug. 8, 1983

[51] Int. Cl.[3] ..... F02F 1/42

[52] U.S. Cl. ..... 60/272; 123/188 M; 123/193 H

[58] Field of Search ..... 60/272; 123/193 H, 188 M

[56] References Cited

U.S. PATENT DOCUMENTS 2,578,932 12/1951 Hinze et al. .
3,933,142 1/1976 List et al. .
4,159,011 6/1979 Sperry ..... 123/193 H
4,228,653 10/1980 Sperry .
4,302,935 12/1981 Cousimano ..... 60/272

FOREIGN PATENT DOCUMENTS 17108 2/1977 Japan ..... 60/272

*Primary Examiner*—Douglas Hart

[57] ABSTRACT

An exhaust port has inlet and exhaust portions smoothly joined by a connecting portion which forms oppositely facing roof and floor walls. The roof is formed into flow-dividing projections upstream and downstream of a valve stem. These flow dividers divert flow around the valve stem, thus reducing flow separation and losses.

9 Claims, 8 Drawing Figures

Fig. 8
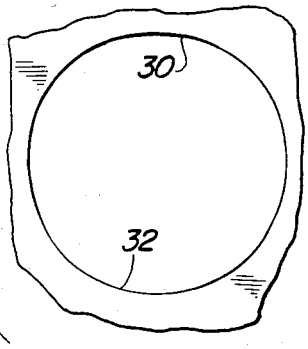
Fig. 2
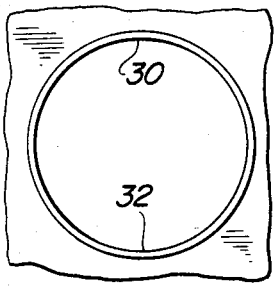
Fig. 3
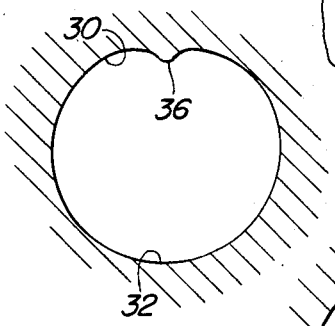
Fig. 4
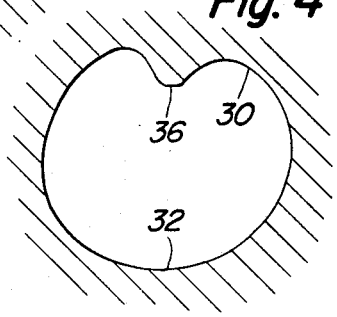
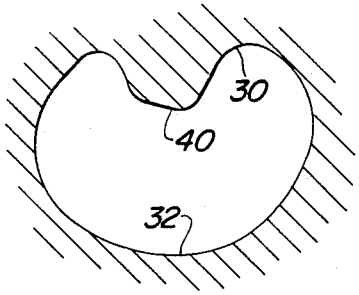
Fig. 5
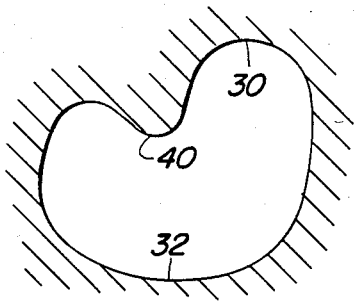
Fig. 6
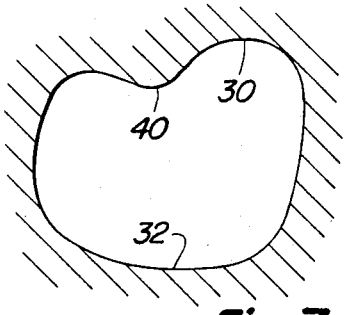
Fig. 7

EXHAUST PORT

BACKGROUND OF THE INVENTION

The present invention relates to an exhaust port for an internal combustion engine.

Internal combustion engines use an exhaust port and valve to transport combustion gasses from the cylinder to the exhaust manifold. This transport of exhaust gasses uses up energy which otherwise could be applied to the engine crankshaft to do useful work. Various exhaust port geometries have been used in attempts to improve exhaust port performance. One technique is to reduce the cross-sectional area of the exhaust port through its bend. This presumably reduces flow separation losses by accelerating the gas flow. Another solution has been to double the number of intake and exhaust valves to increase the "breathing" capability of the engine. It is costly to increase the number of valves; therefore, it would be desirable to provide an improved port design which improves the transport of exhaust gasses without increasing the number of exhaust ports.

SUMMARY OF THE INVENTION

An object of the present invention is to provide an exhaust port for efficiently transporting exhaust gasses from the cylinder of an internal combustion engine.

This and other objects are achieved by the present invention which provides an exhaust port having convex flow dividers upstream and downstream of the stem of an exhaust valve which reciprocates in the exhaust port. The exhaust port has a roof and a floor with the valve stem extending through the roof. The flow dividers are formed in the roof and the floor is concave throughout its extent.

BRIEF DESCRIPTION OF THE DRAWINGS

FIGS. 2 through 8 are contours of the exhaust port taken along lines 2—2 through 8—8, respectively, of FIG. 1.

DETAILED DESCRIPTION

Figure 1:
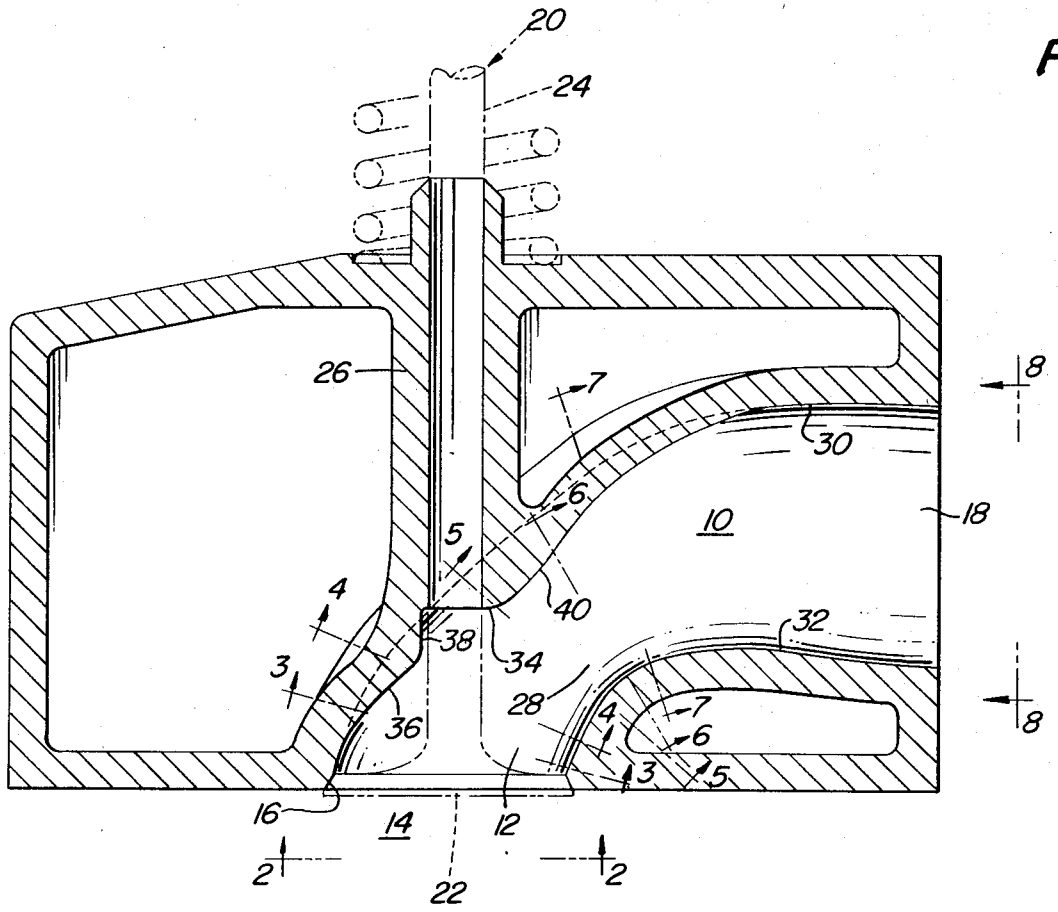
FIG. 1 is a sectional view of an exhaust port constructed according to the present invention.

An exhaust port 10 has a throat portion 12 communicating with a closed end of a cylinder 14 of an internal combustion engine through a generally circular valve seat 16. Port 10 also has an exhaust portion 18 which is substantially circular at its end, as best seen in FIG. 8. A poppet exhaust valve 20 with a head 22 and a stem 24 moves reciprocally in a valve guide 26 and extends into the port 10 to control communication between cylinder 14 and the port 10.

The throat and exit portions are smoothly joined by a connecting portion 28 which has a roof 30 and a floor 32. The floor 32 is opposite the roof 30 and, as best seen in FIGS. 2–8, has a concave, cross-sectional contour throughout its entire length. The valve stem 24 extends through the roof 30 and is immediately surrounded by a generally annular roof surface portion 34 which is substantially perpendicular to the axis of stem 24. The roof 30 has a first flow dividing, turbulence-reducing bump, projection or convex cross-sectional contour portion 36 which is upstream of the stem 24 and which is upstream and connected to the annular portion 34. This contour portion 36 has a wall 38 which is parallel to the axis of stem 24.

The roof 30 also defines or forms a second flow dividing, turbulance-reducing bump, projection or convex cross-sectional contour portion 40 which is downstream of and connected to the annular portion 34. Flow divider 36 merges gradually and smoothly with the roof 30 in the direction towards the valve seat 16 and away from stem 24, as best seen in FIGS. 1, 3 and 4. Flow divider 40 merges gradually and smoothly with the roof 30 in the direction away from stem 24 and towards exhaust portion 18, as best seen in FIGS. 1, 6 and 7. The upstream and downstream flow-dividers 36 and 40 operate to divide gas flow around stem 24, thereby reducing turbulance and improving gas flow through the port 10. The flow dividers 36 and 40 also reduce the cross-sectional area of the exhaust port in the region of its bend, thus reducing flow separation and losses. This flow-enhancing structure could be formed either in the cast iron of the engine cylinder head or block or in a high temperature port liner, such as stainless steel or ceramic.

While the invention has been described in conjunction with a specific embodiment, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

I claim:

1. In an internal combustion engine having a cylinder closed at one end, an exhaust port communicating with the cylinder through the closed end and a poppet exhaust valve disposed in the port and having head and stem portions reciprocal along an axis for controlling communication of the cylinder with the exhaust port, the exhaust port comprising:

a wall having a first flow-divider projecting therefrom upstream of the valve stem, the first flow-divider merging gradually and smoothly with the wall in a direction away from the valve stem, the wall also having a second flow-divider projecting therefrom downstream of the valve stem, the second flow-divider merging gradually and smoothly with the wall in a direction away from the valve stem, the flow-dividers cooperating to reduce turbulence in gasses flowing through the exhaust port and around the valve stem.

2. The exhaust port of claim 1, further comprising:

a throat portion opening into the cylinder and defining a valve seat engageable with the exhaust valve;

an exit portion; and a connecting portion smoothly joining the throat and exit portions, said portions defining a roof through which extends the exhaust valve stem, the first and second flow-dividers being formed in the roof.

3. The exhaust port of claim 2, wherein:

the roof forms a generally annular surface immediately surrounding the exhaust valve stem and substantially perpendicular thereto.

4. The exhaust port of claim 1, wherein:

the throat, exit and connecting portions define a floor opposite the roof, the floor having a concave cross-sectional contour through its entire extent.

5. The exhaust port of claim 3, wherein:

the first flow-divider has a wall portion adjacent to and substantially perpendicular to the annular surface and substantially parallel to the valve stem axis.

6. In an internal combustion engine having a cylinder closed at one end, an exhaust port communicating with the cylinder through the closed end and a poppet exhaust valve disposed in the port and having head and stem portions reciprocal along an axis for controlling communication of the cylinder with the exhaust port, the exhaust port comprising:

a throat portion opening into the cylinder and defining a valve seat engageable with the exhaust valve;

an exit portion; and a connecting portion smoothly joining the throat and exit portions, said portions defining a roof through which extends the exhaust valve stem, the roof having a first flow-divider projecting therefrom and merging gradually and smoothly with the roof in the direction away from the valve stem, and having a second flow-divider projecting therefrom and merging gradually and smoothly with the roof in the direction away from the valve stem, the flow-dividers cooperating to reduce turbulence in gasses flowing through the exhaust port and around the valve stem.

7. The exhaust port of claim 6, wherein the roof forms a generally annular surface immediately surrounding the exhaust valve stem and substantially perpendicular thereto.

8. The exhaust port of claim 7, wherein:

the first flow-divider has a wall portion adjacent to and substantially perpendicular to the annular surface and substantially parallel to the valve stem axis.

9. The exhaust port of claim 8, wherein:

the throat, exit and connecting portions define a floor opposite the roof, the floor having a concave cross-sectional contour through its entire extent.

* * * * *

Disclaimer 4,537,028.—*Albert L. Humke,* Cedar Falls, Iowa. EXHAUST PORT. Patent dated Aug. 27, 1985. Disclaimer filed Nov. 24, 1986, by the assignee, *Deere & Co.*

Hereby enters this disclaimer to all claims of said patent.

[*Official Gazette February 3, 1987.*]